US009978503B2

(12) United States Patent
Gu et al.

(10) Patent No.: US 9,978,503 B2
(45) Date of Patent: May 22, 2018

(54) TRANSFORMER WINDING, TRANSFORMER HAVING THE SAME AND MANUFACTURING METHOD THEREOF

(71) Applicant: Delta Electronics (Jiangsu) Ltd., Jiangsu Province (CN)

(72) Inventors: Caili Gu, Jiangsu Province (CN); Song Luo, Jiangsu Province (CN); Mingqiang Zhu, Jiangsu Province (CN)

(73) Assignee: DELTA ELECTRONICS (JIANGSU) LTD., Jiangsu Province (CN)

( * ) Notice: Subject to any disclaimer, the term of this patent is extended or adjusted under 35 U.S.C. 154(b) by 238 days.

(21) Appl. No.: 14/834,451

(22) Filed: Aug. 25, 2015

(65) Prior Publication Data

US 2016/0233018 A1 Aug. 11, 2016

(30) Foreign Application Priority Data

Feb. 11, 2015 (CN) ..... 2015 1 0072312

(51) Int. Cl.
*H01F 27/29* (2006.01)
*H01F 27/28* (2006.01)
*H01F 27/32* (2006.01)

(52) U.S. Cl.
CPC ..... *H01F 27/2823* (2013.01); *H01F 27/2885* (2013.01); *H01F 27/29* (2013.01); *H01F 27/323* (2013.01); *H01F 27/325* (2013.01)

(58) Field of Classification Search
CPC ..... H01F 27/00–27/36
USPC ..... 336/65, 83, 196, 198, 200, 206–208, 336/220–223, 232
See application file for complete search history.

(56) References Cited

U.S. PATENT DOCUMENTS 4,617,543 A * 10/1986 Akachi ..... H01F 27/29 336/192
5,606,152 A * 2/1997 Higashiura ..... H01B 3/421 174/120 R
5,696,477 A * 12/1997 Yamamori ..... H01F 27/027 336/185
7,541,908 B2 * 6/2009 Kitahara ..... H01F 27/323 336/206

(Continued)

FOREIGN PATENT DOCUMENTS

JP 10-22131 A 1/1998
TW 559838 B 11/2003
TW I334613 B 12/2010

*Primary Examiner* — Tuyen Nguyen
(74) *Attorney, Agent, or Firm* — CKC & Partners Co., Ltd.

(57) ABSTRACT

The present application provides a transformer, a transformer winding component and manufacturing methods thereof. The transformer winding component comprises a bobbin and at least two windings, wherein the bobbin includes a cylinder, and the at least two windings are wound on the outside of the cylinder. The at least two windings are sequentially disposed from inside to outside relative to the cylinder, and comprise a first fold winding. The transformer winding component further comprises an insulation layer and a fold tape. The insulation layer is adjacently disposed on the outside of the first fold winding. A portion of fold tape is located on the inner side of the first fold winding, and another portion of fold tape is located on the outside of the insulation layer. The transformer comprises a core and the transformer winding component.

9 Claims, 4 Drawing Sheets

(56) References Cited

U.S. PATENT DOCUMENTS 8,289,120 B2 * 10/2012 Tada ..... H01F 27/06
336/192

* cited by examiner

TRANSFORMER WINDING, TRANSFORMER HAVING THE SAME AND MANUFACTURING METHOD THEREOF

CROSS-REFERENCE TO RELATED APPLICATIONS

This non-provisional application claims priority under 35 U.S.C. § 119(a) on Patent Application No. 201510072312.8 filed in P.R. China on Feb. 11, 2015, the entire contents of which are hereby incorporated by reference.

Some references, if any, which may include patents, patent applications and various publications, may be cited and discussed in the description of this application. The citation and/or discussion of such references, if any, is provided merely to clarify the description of the present application and is not an admission that any such reference is "prior art" to the application described herein. All references listed, cited and/or discussed in this specification are incorporated herein by reference in their entireties and to the same extent as if each reference was individually incorporated by reference.

FIELD OF THE PRESENT APPLICATION

The present application relates to the technical field of transformer, and particularly to a transformer winding component and a manufacturing method thereof.

RELATED ART

With the development of electronic technology, transformers are widely applied to various fields, such as a communication power supply, a mobile phone base station, a DC converter, etc. Moreover, as a result of the advance in manufacturing process, the volume of transformer becomes smaller and smaller, and the power thereof becomes higher and higher.

As shown in FIG. 1, an existing transformer winding component 10 generally comprises a bobbin 11 and a coil winding 13, and the coil winding 13 includes a primary winding 131, a secondary winding 132 and a metal foil layer 133, wherein the primary winding 131 and the secondary winding 132 are wound within the range of a window width M of the bobbin 11, and the metal foil layer 133 is disposed between the primary winding 131 and the secondary winding 132. In the existing design, an insulation layer 151 (the insulation layer may be an insulation tape or made of other insulation material) is attached between the primary winding 131 and the metal foil layer 133, an insulation layer 152 is attached between the metal foil layer 133 and the secondary winding 132, and an insulation tape 153 is attached to the outside of the secondary winding 132. Moreover, a fold tape 17 is attached to the end portion of the secondary winding 132, so as to prevent short circuit caused due to the crossing of an outgoing wire of the primary winding 131 with the secondary winding 132. In the prior art, however, the fold tape 17 starts before a winding and ends after the winding. Due to such a design, the process for manufacturing the transformer winding component 10 is as follows: winding the primary winding 131—covering the outer circumference of the primary winding 131 with the insulation layer 151—disposing the metal foil layer 133—disposing the insulation layer 152 on the outside of the metal foil layer 133—attaching the fold tape 17 on the outside of the insulation layer 152—winding the secondary winding 132—folding the fold tape 17 at the end portion of the secondary winding 132—attaching the insulation tape 153. In this manufacture process, the folding action of the fold tape 17 is directly performed on the secondary winding 132 which has just been wound, and if no treatment is performed on the secondary winding 132, the secondary winding 132 which has just been wound may become a loose coil, that is, the folding of the fold tape 17 is performed on the loose coil, which necessarily makes the attachment of the folded portion of the fold tape more difficult and must require help from workers, thus the manufacture of the transformer winding component wastes manpower, increases costs, and makes the quality unstable.

SUMMARY OF THE INVENTION

With respect to the problems of the existing transformer winding component, the technical problem to be solved by the present application is to provide a transformer winding component which can be produced automatically, saves manpower and has a stable quality.

To solve the above-mentioned technical problem, the present application discloses a transformer winding component comprising a bobbin and at least two windings, wherein the bobbin including a first blade, a second blade, and a cylinder for connecting the first blade with the second blade, the at least two windings being wound on the outside of the cylinder and being located between the first blade and the second blade, and the at least two windings being sequentially disposed from inside to outside relative to the cylinder. The at least two windings comprises a first fold winding, wherein the transformer winding component further comprising an insulation layer adjacently disposed on the outside of the first fold winding, and a fold tape, a portion of which is located on the inner side of the first fold winding, and another portion of which is located on the outside of the insulation layer.

The present application also discloses a method of manufacturing a transformer winding component, comprising the steps of:

providing a bobbin comprising a cylinder; and winding at least two windings on the outside of the cylinder, wherein the at least two windings comprising a first fold winding, and during the winding of the at least two windings, there being included a step of disposing an insulation layer on the outside of the first fold winding and a step of disposing a fold tape at the first fold winding, wherein when the fold tape is disposed, the fold tape starts before the first fold winding and ends after the insulation layer disposed on the outside of the first fold winding.

The present application still discloses a transformer comprising a core and the above transformer winding component.

The beneficial effects of the present application are as follows: by means of the disposing the fold tape of the transformer winding component which starts before the first fold winding and ends after the insulation layer disposed on the outside of the first fold winding, the folding operation of the fold tape is performed on a winding covered with the insulation layer, thus there may be no need to consider the problem of loose of the winding during the folding operation, and a manual labor may be further no needed to insure the folding and attaching effect, thereby enabling to be automatically produced, saving manpower and improving the product quality.

Hereinafter, the present application is described in detail with reference to the accompanying drawings and specific embodiments, which, however, are not to limit the present application.

DESCRIPTION OF THE PREFERRED EMBODIMENT

Hereinafter, the technical solution of the present application is described in detail with reference to the accompanying drawings and specific embodiments, so as to further make clear the object, solution and effect of the present application, rather than limit the protection scope of the appended claims of the present application.

One embodiment of the present application may be mainly applied to a transformer winding component with windings having a wire diameter of 0.08 to 1.2 mm, but the present application is not limited thereto.

By changing the attachment order of the conventional fold tape, the fold tape starts before a first fold winding (also may be called as a current winding) and ends after the insulation layer disposed on the outside of the current winding. Next, the transformer winding component according to the present application will be explained in detail with reference to several embodiments.

First Embodiment of Transformer Winding Component

Figure 1:
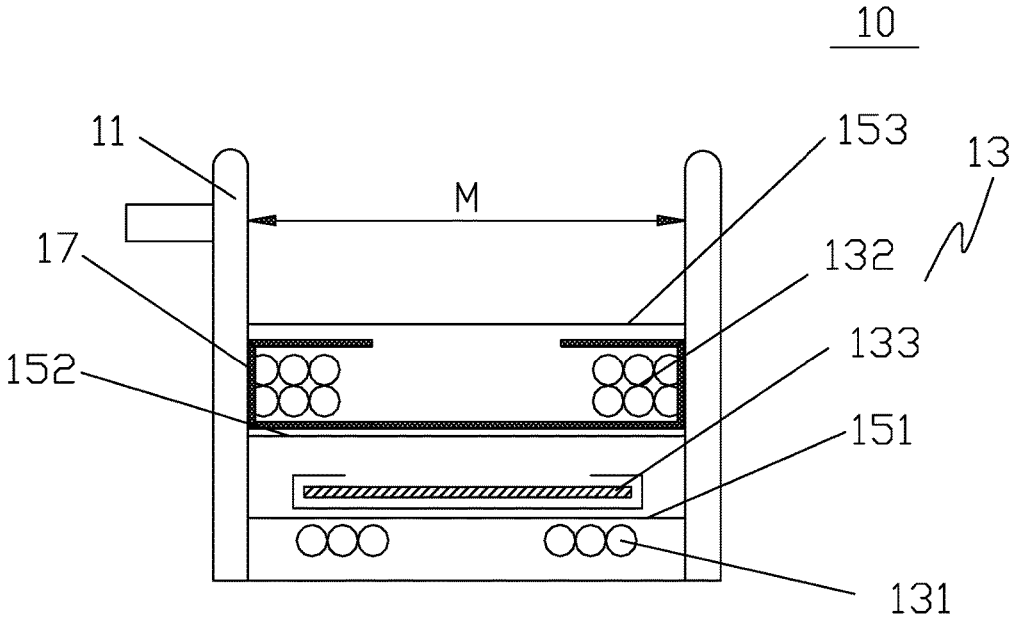
(Prior Art) Fig. 1
FIG. 1 is a structure diagram of a transformer winding component according to the prior art.
Figure 2:
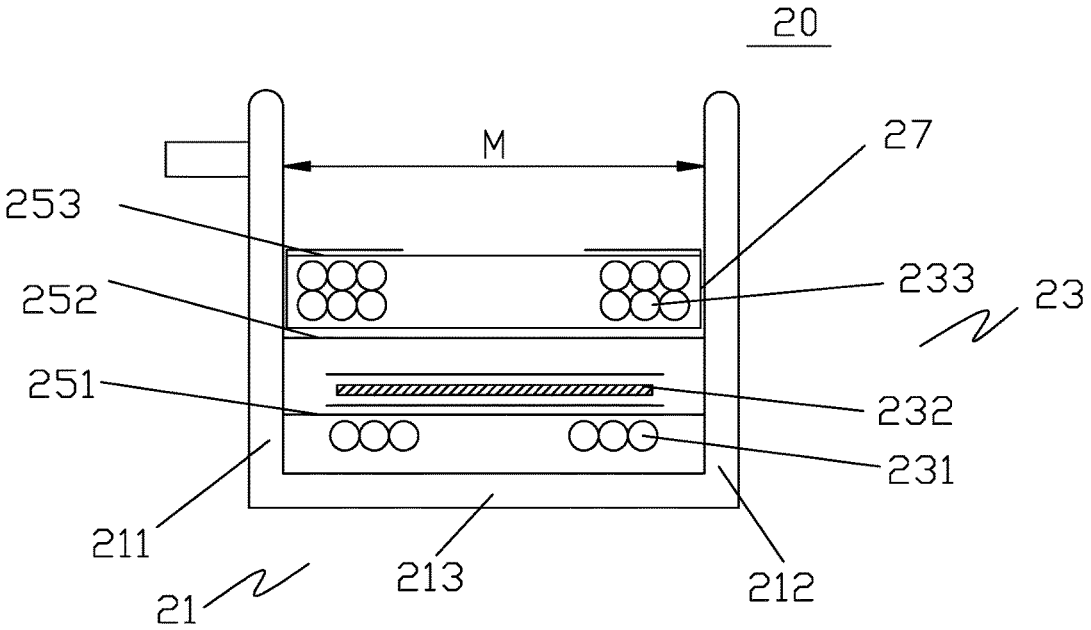
FIG. 2 is a structure diagram of a transformer winding component according to an embodiment of the present application.

Referring to FIG. 2, the transformer winding component 20 of this embodiment comprises a bobbin 21 and windings 23. The bobbin 21 comprises a first blade 211, a second blade 212 and a cylinder 213 for connecting the first blade 211 with the second blade 212, and the windings 23 may be disposed on the outside of the cylinder 213 and may be located between the first blade 211 and the second blade 212. Since the distance between the first blade 211 and the second blade 212 constitutes a window width M of the bobbin 20, the windings 23 may be wound within the range of the window width M of the bobbin 20.

In this embodiment, the number of the windings 23 may be two, namely a first winding 231 and a second winding 233 (for convenience, the second winding 233 in this embodiment may also be called as a first fold winding), but the invention is not limited thereto. A metal foil layer 232 may be provided between the first winding 231 and the second winding 233. The first winding 231 and the second winding 233 may be sequentially disposed from inside to outside relative to the cylinder 213, but the invention is not limited thereto. An insulation layer 251 may be disposed on the outside of the first winding 231, an insulation layer 252 may be disposed on the outside of the metal foil layer 232, the outside of the second winding 233 may be covered with an insulation layer 253, and a fold tape 27 may be disposed at the second winding 233 so as to prevent an outgoing wire of the first winding 231 from contacting the second winding 233. However, the present application is not limited thereto, and position of respective layers can be adjusted or increased/decreased according to different applications. The fold tape 27 may start before the first fold winding and end after the insulation layer 253 disposed on the outside of the first fold winding. In terms of structure, a portion of the fold tape 27 is located on the inner side of the corresponding fold winding (the second winding 233), and a portion thereof is positioned on the outside of the insulation layer (the insulation layer 253) adjoining to the corresponding fold winding.

It should be noted that the "winding" as stated herein is not limited to a structure or component made of a wound coil, but further comprises a modified structure or component such as "a metal foil layer".

Figure 3:
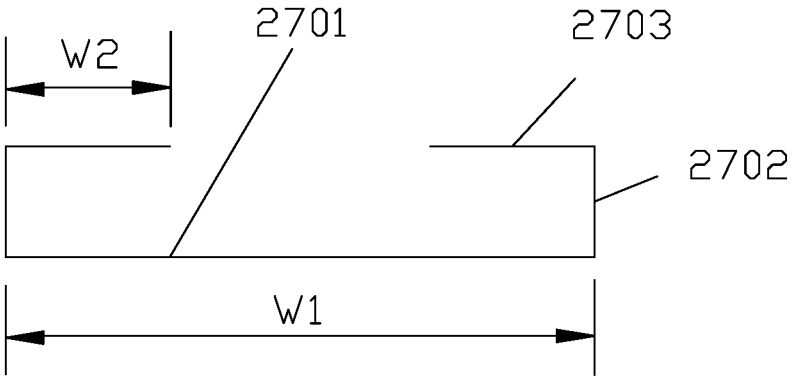
FIG. 3 is a schematic diagram of a fold tape as shown in FIG. 2.

Referring to FIG. 3, the fold tape 27 includes an interlayer portion 2701, bent portions 2702 and folded portions 2703. The interlayer portion 2701 may be located between two adjacent windings (e.g., the first winding 231 and the second winding 233 in this embodiment); one bent portion 2702 may be located between the first fold winding (i.e., the second winding 233 in this embodiment) and the second blade 212, and the other bent portion 2702 may be located between the second winding 233 and the first blade 211; and the folded portions 2703 are located on the outside of the insulation layer 253 disposed on the outside of the first fold winding. It should be noted that in this embodiment, a case in which both ends of the second winding 233 are provided with the fold tapes is given, whereas in practical application, it is possible that only one end of the second winding 233 is provided with the fold tape. As to whether only one end of the second winding 233 is provided with the fold tape or both ends thereof are provided with the fold tapes, it may depend on the situation of outgoing wire of the first winding 231, but the invention is not limited thereto. If there are outgoing wires in both ends of the first winding 231, both ends of the second winding 233 may be provided with the fold tapes in order to avoid short circuit caused due to crossing of the outgoing wires with the second winding 233. Moreover, in order to make it easy to dispose the fold tapes, the fold tapes in the two ends may share the same one interlayer portion 2701 so that the fold tapes in the two ends are integrated to form the structure shown in FIG. 3, but the present application is not limited thereto. The length W1 of the interlayer portion 2701 formed by the structure shown in FIG. 3 may be equivalent to the axial length L (i.e., window width M) of the cylinder. If there is an outgoing wire in just one end of the first winding 231, a fold tape may be provided only at the end where there is the outgoing wire. In one embodiment, the ratio between the length W2 of the folded portion 2703 and the axial length L of the cylinder can be $W2<\frac{1}{2}L$, but the present application is not limited thereto.

Figure 4:
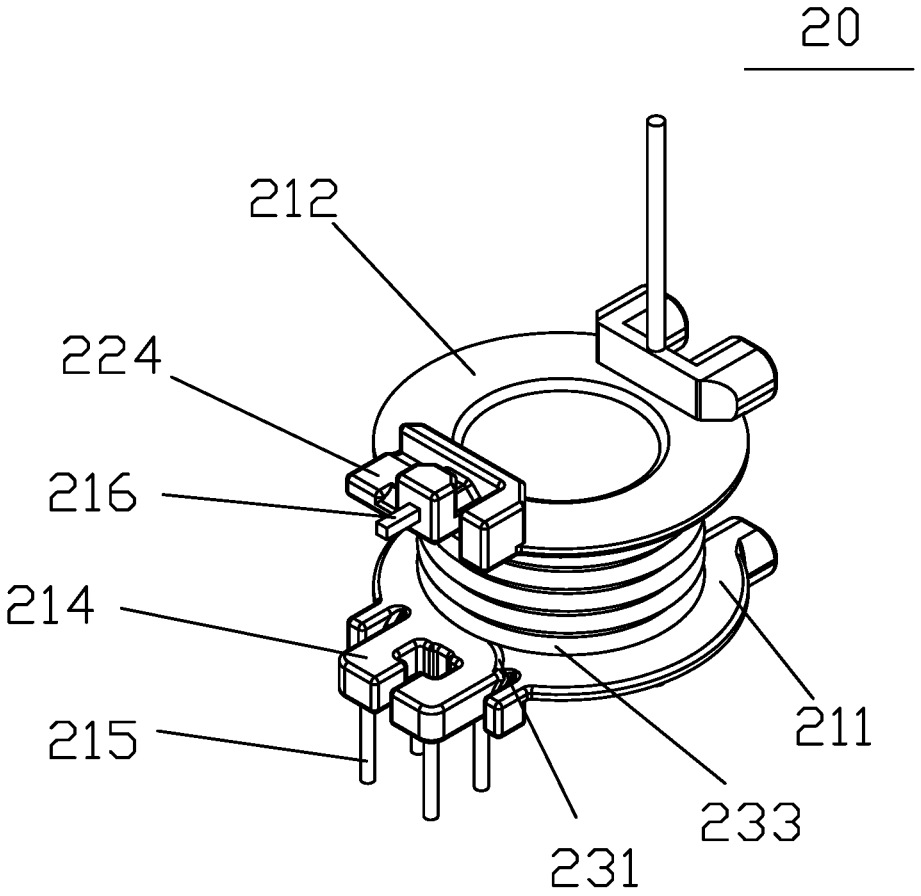
FIG. 4 is a solid diagram of the transformer winding component as shown in FIG. 2.

Referring to FIG. 4, a protrusion 214 may be provided on the first blade 211, a protrusion 224 may be provided on the second blade 212, a plurality of leads 215 may be provided on the protrusion 214, a lead 216 may be provided on the protrusion 224, the leads 215 may be parallel to the axis of the cylinder 213, and the lead 216 may be perpendicular to the axis of the cylinder 213, but the present application is not limited thereto. The outgoing wires of the first winding 231, or the outgoing wires of the second winding 233 or the like may be electrically connected not only to the leads 215 but also to the lead 216, thereby avoiding the problem of complex wiring and easy short circuit caused by the crossed wiring or the like, but the invention is not limited thereto.

The method of manufacturing the transformer winding component in an embodiment mainly comprises the steps of:

S100: providing a bobbin 21 including a first blade 211, a second blade 212 and a cylinder 213;

S200: winding at least two windings 231 and 233 on the outside of the cylinder 213, wherein the at least two windings comprise a first fold winding. During the winding of the at least two windings, there are included a step of disposing an insulation layer on the outside of the first fold winding and a step of disposing a fold tape at the first fold winding. When the fold tape is disposed, the fold tape starts before the first fold winding and ends after the insulation layer disposed on the outside of the first fold winding.

In the above-mentioned step S200, when an outgoing or incoming wire of a winding crosses with other winding, it may be determined that the other winding is a winding of which the end may be provided with a fold tape, namely a first fold winding, but the invention is not limited thereto. In this embodiment, the outgoing wire of the winding 231 crosses with the winding 233 (as shown in FIG. 4), thus it may be provided with a fold tape.

In an embodiment, if the electric field shielding effect between the first winding 231 and the second winding 233 satisfies the requirements, a metal foil layer may not be disposed between the first winding 231 and the second winding 233.

Second Embodiment of Transformer Winding Component

Figure 5:
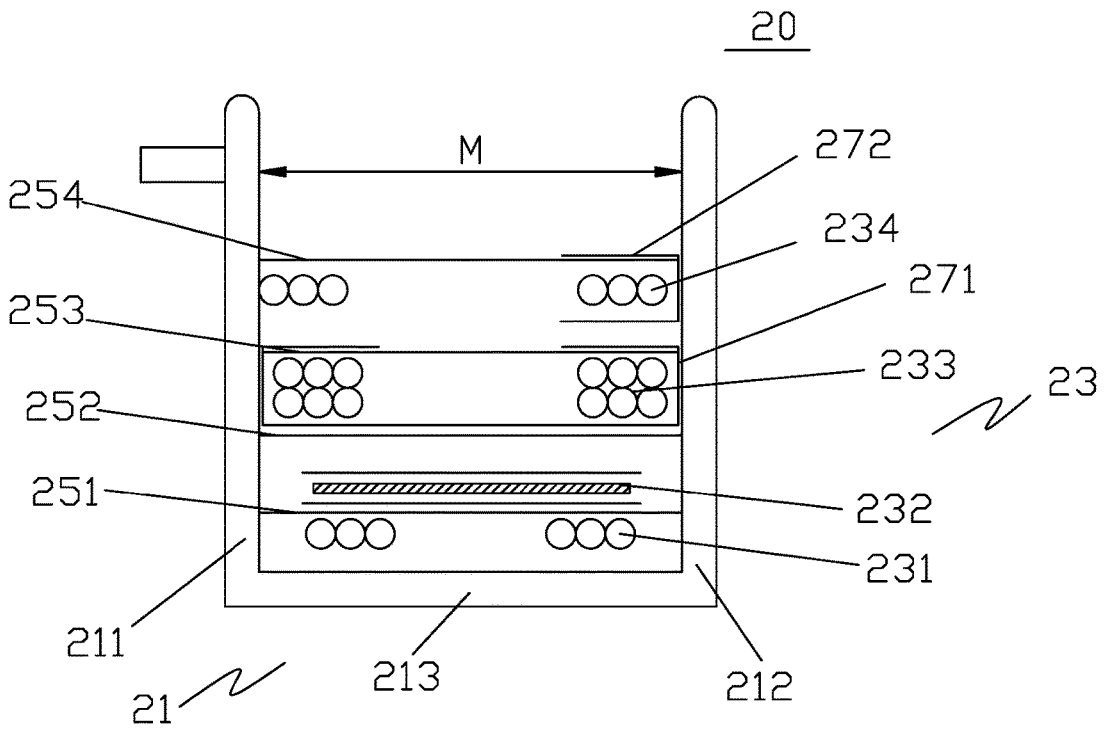
FIG. 5 is a structure diagram of a transformer winding component according to another embodiment of the present application.
Figure 6:
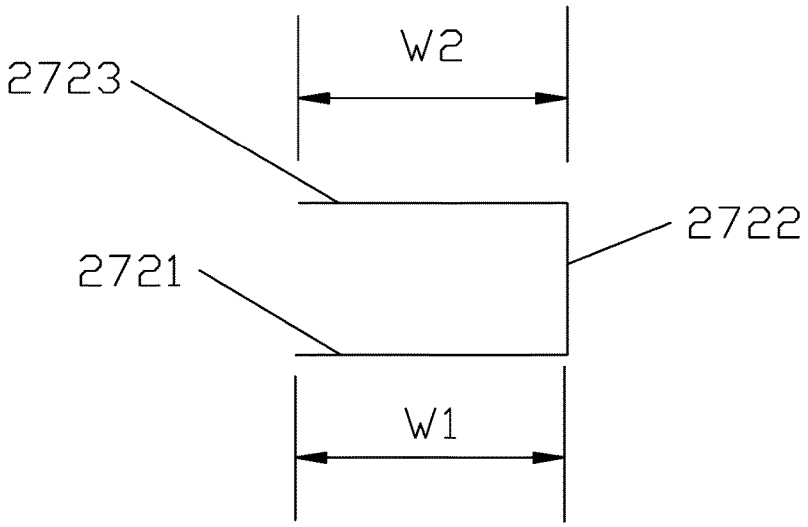
FIG. 6 is a schematic diagram of a fold tape as shown in FIG. 5.

As shown in FIGS. 5 and 6, the structure of the transformer winding component in the second embodiment of the present application is substantially same as that in the first embodiment, and the difference may be as follows: the number of windings 23 is three, namely a first winding 231, a second winding 233 and a third winding 234, an insulation layer 254 may be disposed on the outside of the third winding 234 (for example, the insulation layer 254 is disposed adjacent to the outside of the winding 234), the end of the second winding 233 may be provided with a fold tape 271 and the end of the third winding 234 may be provided with a fold tape 272, wherein the fold tape 272 starts before the first fold winding (i.e., the third winding 234 in this embodiment) and ends after the insulation layer 254 covering the outside of the first fold winding. The structure of the fold tape 271 may be same as that of the fold tape 27 in the first embodiment. The fold tape 272 may include an interlayer portion 2721, a bent portion 2722 and a folded portion 2723. The interlayer portion 2721 is located between two adjacent windings (i.e., the second winding 233 and the third winding 234 in this embodiment); the bent portion 2722 is located between the first fold winding (i.e., the third winding 234 in this embodiment) and the second blade 212; and the folded portion 2723 may be located on the outside of the insulation layer 254 which is disposed on the outside of the first fold winding. The ratio between the length W1 of the interlayer portion 2721 and the axial length L of the cylinder may be W1<½ L, and the ratio between the length W2 of the folded portion 2723 and the axial length L of the cylinder may be W2<½ L. The present application is not limited thereto.

The structures of the other parts of the transformer winding component in the second embodiment may be same as those of the first embodiment, thus no further details are provided here.

In the transformer winding component of the second embodiment, a metal foil layer may further be provided between the second winding 233 and the third winding 234, but the present application is not limited thereto.

Moreover, in the transformer winding component of the second embodiment, the lead 216 may be used as a middle connection point between two windings.

The method of manufacturing the transformer winding component in this embodiment may be basically same as that of the first embodiment, and the difference may be as follows: the number of the windings to be wound is different (in this embodiment, three windings are wound), and the windings of which the ends are provided with fold tapes are slightly different (in this embodiment, the ends of the second winding 233 and the third winding 234 are provided with fold tapes).

Third Embodiment of Transformer Winding Component

Figure 7:
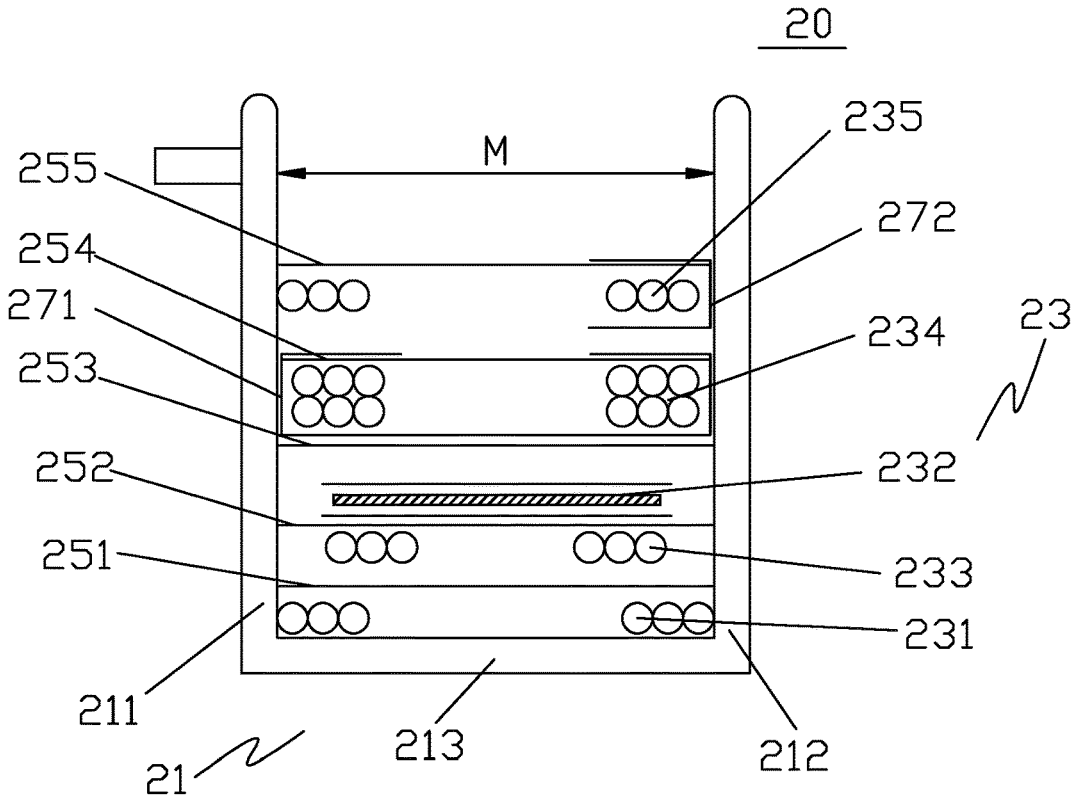
FIG. 7 is a structure diagram of a transformer winding component according to still another embodiment of the present application.

As shown in FIG. 7, the structure of the transformer winding component in the third embodiment of the present application may be substantially same as that in the first embodiment, and the difference may be as follows: the number of windings 23 is four, namely a first winding 231, a second winding 233, a third winding 234 and a fourth winding 235, the outside of the third winding 234 is covered with an insulation layer 254, the outside of the fourth winding 235 is covered with an insulation layer 255, a metal foil layer 232 is disposed between the second winding 233 and the third winding 234, the end of the third winding 234 is provided with a fold tape 271, and the end of the fourth winding 235 is provided with a fold tape 272, wherein the fold tape 271 starts before a first fold winding (i.e., the third winding 234 in this embodiment) and ends after the insulation layer 254 disposed on the outside of the first fold winding, and the fold tape 272 starts before a second fold winding (i.e., the fourth winding 235 in this embodiment) and ends after the insulation layer 255 disposed on the outside of the second fold winding. The structures of the fold tapes 271 and 272 are same as that of the second embodiment. The invention is not limited thereto.

The structures of the other parts of the transformer winding component in the third embodiment may be same as those of the first embodiment, thus no further details are provided here.

In the transformer winding component of the third embodiment, a metal foil layer may further be provided between the first winding 231 and the second winding 233, and a metal foil layer may further be provided between the third winding 234 and the fourth winding 235, but the present application is not limited thereto.

The method of manufacturing the transformer winding component in this embodiment may be basically same as that of the first embodiment, and the difference may be as follows: the number of the windings to be wound is different (in this embodiment, four windings are wound), and the windings of which the ends are determined to be provided with fold tapes are slightly different (in this embodiment, the ends of the third winding 234 and the fourth winding 235 (i.e., the first fold winding and the second fold winding) are determined to be provided with fold tapes).

The terms such as "first fold winding" and "second fold winding" as used herein are used only for convenience. They are neither limited to the first winding and the second winding (for example, the third winding and the fourth winding may also be indicated as the "first fold winding" and the "second fold winding"), nor limited to windings formed by winding coils (for example, they may also be a metal foil layer and the like).

Embodiment of Transformer

Figure 8:
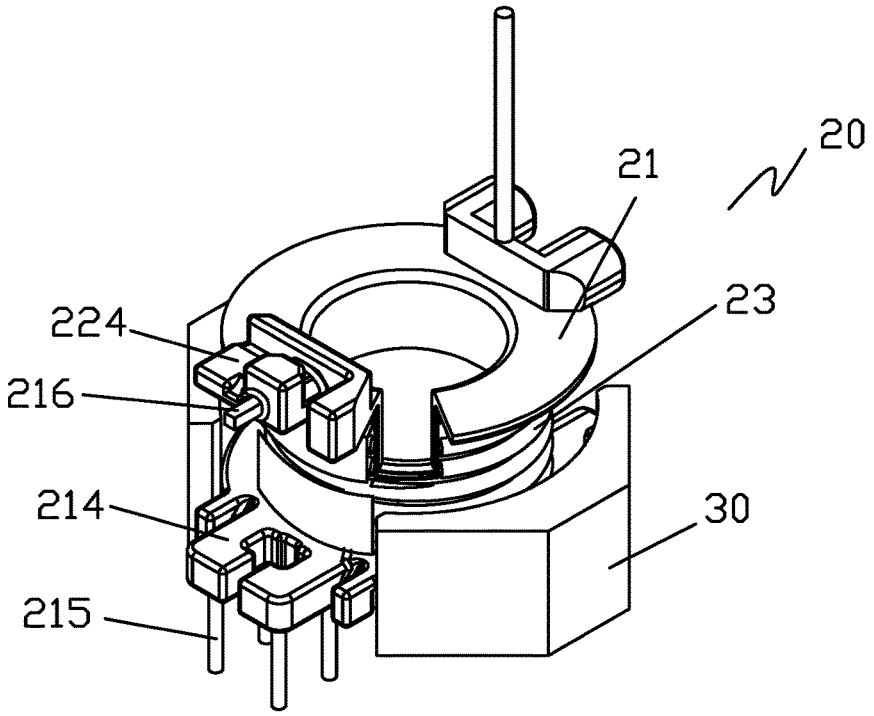
FIG. 8 is a solid diagram of the transformer of the present application.

As shown in FIG. 8, the transformer according to an embodiment of the present application includes a core 30 and a transformer winding component 20, wherein the transformer winding component 20 may be one described, manufactured or varied in any of the above embodiments.

The transformer according to the present application is not limited to the specific structures described in the above embodiments. In the actual manufacture, the transformer may be formed by freely combining a core with a transformer winding component arbitrarily selected from those of the embodiments.

Of course, the present application may have a variety of other embodiments. Those skilled in the art can make all kinds of corresponding changes and modifications according to the present application without departing from the spirit and essence of the present application. It is intended that all these corresponding changes and modifications fall within the scope of the appended claims of the present application.

What is claimed is:

1. A transformer winding component comprising a bobbin and at least two windings, wherein the bobbin including a first blade, a second blade, and a cylinder connecting the first blade and second blade, the at least two windings being wound on the outside of the cylinder and being located between the first blade and the second blade, and the at least two windings being sequentially disposed from inside to outside relative to the cylinder, and the at least two windings comprising a first fold winding, wherein the transformer winding component further comprising an insulation layer and a fold tape, wherein the insulation layer is adjacently disposed on the outside of the first fold winding, and a portion of the fold tape is located on the inner side of the first fold winding, and another portion of the fold tape is located on the outside of the insulation layer.

2. The transformer winding component according to claim 1, wherein the fold tape comprises:

an interlayer portion located between two adjacent windings of the at least two windings;

a bent portion located between the first fold winding and the first blade, or located between the first fold winding and the second blade, or located between the first fold winding, the first blade and the second blade: and a folded portion located on the outside of the insulation layer.

3. The transformer winding component according to claim 2, wherein a length of the interlayer portion is equivalent to an axial length of the cylinder.

4. The transformer winding component according to claim 2, wherein a ratio between a length W1 of the interlayer portion and an axial length L of the cylinder is W1<½ L.

5. The transformer winding component according to claim 2, wherein the ratio between a length W2 of the folded portion and an axial length L of the cylinder is W2<½ L.

6. The transformer winding component according to claim 1, wherein a wire diameter of the windings is 0.08 to 1.2 mm.

7. The transformer winding component according to claim 1, wherein the first blade and the second blade are provided with a protrusion, and at least one lead perpendicular to the axis of the cylinder is provided on the protrusion.

8. The transformer winding component according to claim 1, further comprises a metal foil layer.

9. A transformer comprising a core and a transformer winding component, wherein the transformer winding component is a transformer winding component as defined in claims 1.

* * * * *